US005266081A

United States Patent [19]

Avery et al.

[11] Patent Number: 5,266,081

[45] Date of Patent: Nov. 30, 1993

[54] MULTIFUNCTIONAL ASHLESS DISPERSANTS

[75] Inventors: Noyes L. Avery, Bryn Mawr, Pa.; Angeline B. Cardis, Florence, N.J.; James V. DeFrancesco, Bensenville, Ill.; Virginia C. Wiszniewski, Voorhees, N.J.

[73] Assignee: Mobil Oil Corporation, Fairfax, Va.

[21] Appl. No.: 779,456

[22] Filed: Oct. 18, 1991

[51] Int. Cl.[5] ..... C10L 1/22

[52] U.S. Cl. ..... 44/331; 44/346; 44/347; 44/348; 548/520; 548/546

[58] Field of Search ..... 44/331, 346, 347, 348; 548/520, 546

[56] References Cited

U.S. PATENT DOCUMENTS

| | | | |
|---|---|---|---|
| 3,039,860 | 6/1962 | Andress, Jr. et al. | 44/348 |
| 3,586,629 | 6/1971 | Otto et al. | 44/330 |
| 3,649,229 | 3/1972 | Otto | 44/347 |
| 4,153,564 | 5/1979 | Chibnik | 44/347 |
| 4,165,329 | 8/1979 | Dreher et al. | 252/33 |
| 4,177,192 | 12/1979 | Heiba et al. | 252/33 |
| 4,409,000 | 10/1983 | LeSuer | 44/331 |
| 4,460,381 | 7/1984 | Karol et al. | 44/348 |
| 4,501,595 | 2/1985 | Sung et al. | 44/347 |
| 4,533,361 | 8/1985 | Sung et al. | 44/347 |
| 4,895,579 | 1/1990 | Andress et al. | 44/331 |
| 5,102,570 | 4/1992 | Migdal | 252/50 |
| 5,160,649 | 11/1992 | Cardis et al. | 252/47.5 |

*Primary Examiner*—Margaret Medley
*Attorney, Agent, or Firm*—Alexander J. McKillop; Malcolm D. Keen; Jessica M. Sinnott

[57] ABSTRACT

A fuel additive is the reaction product of an intermediate reaction product of a hydrocarbon-substituted succinic anhydride and an aminosalicylic acid, preferably a 4-aminosalicylic acid. The intermediate is reacted with an aldehyde, preferably formaldehyde and an alkylenepolyamine preferably tetraethylenepentamine. The reaction product is post reacted with a hydrocarbon-substituted succinic anhydride which can be the same or different as the hydrocarbon-substituted succinic anhydride of the intermediate. The additive has dispersant and detergent properties and is effective in liquid hydrocarbon or liquid oxygenated fuels or mixtures of the said fuels.

18 Claims, No Drawings

MULTIFUNCTIONAL ASHLESS DISPERSANTS

FIELD OF THE INVENTION

The invention is directed to multifunctional ashless dispersants for fuels. Specifically the invention is directed to aminosalicylic acid-derived succinimides as fuel additives.

BACKGROUND OF THE INVENTION

In internal combustion engines operating under normal and severe conditions, oil-insoluble particles can form from combustion by-products and products from oxidation of the fuel or lubricant due to high temperatures and the presence of metals which promote oxidation. Although antioxidants can prevent the fuel or lubricant from undergoing oxidation, antioxidants are not always fully effective and oxidation by-products are not the only source of contamination. Thus, additives are needed which can disperse solid particulate matter and keep metal surfaces free of deposits.

Dispersants and detergents are compositions which can facilitate the suspension of oil-insoluble particles to inhibit the agglomeration and accumulation of the particles and settling out of the fluid. Dispersants may actually break up particle agglomerations and bring them into a colloidal suspension or solubilize them. Dispersants and detergents are also important in preventing insoluble matter from forming deposits which adhere to hot metal parts. Lubricating oils and fuels require dispersants and detergents to reduce or prevent formation of deposits on internal combustion engine parts resulting from sludge, varnish and lead compounds. Typically, the dispersants adsorb on the insoluble particles maintaining them as a suspension in the fluid to minimize their deposition and to maintain cleanliness of rings, valves and cylinder walls.

Refinery economics and environmental concerns necessitating conservation of petroleum crude stocks require refiners to make gasolines from lower quality heavy fractions. Although fluid catalytic cracking processes effectively crack these fractions, they produce high olefin content fuels. These fuels are designated "severe" fuels because they are not fully responsive to traditional additive products. Moreover, the presence of diolefins in these fuels can be detrimental to engine operation because they are highly reactive, forming gums and polymers easily. High gum levels cause problems because they separate out and lead to blocked fuel lines which hinder fuel flow, filter plugging, valve plugging, and formation of high sludge levels. They also form deposits on engine parts resulting in poor engine performance and breakdowns. Consequently there is a need for fuel additives which perform effectively in these "severe" fuels.

SUMMARY OF THE INVENTION

The invention is directed to a fuel or lubricant additive which is a multifunctional antioxidant, dispersant and detergent for fuels and lubricants. The additive is made from an aminosalicylic acid derived hydrocarbon-substituted succinimide.

DETAILED DESCRIPTION OF THE INVENTION

The invention is a fuel or lubricant additive comprising a reaction product of a. an intermediate reaction product of a hydrocarbon-substituted succinic anhydride and an aminosalicylic acid;

b. an aldehyde; and c. an alkylenepolyamine. The fuel additive is subsequently reacted with a hydrocarbon-substituted succinic anhydride. The invention is also directed to lubricant and fuel compositions containing the additive and methods of making the same.

The intermediate is a hydrocarbon-substituted succinimide which is characterized by the presence within its structure of the imide group in which two acyl groups are bonded to nitrogen. The compound is made in a reaction between a first hydrocarbon-substituted succinic anhydride and an aminosalicylic acid.

The first hydrocarbon-substituted succinic anhydride has the structural formula:

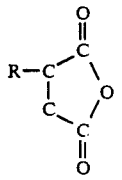

where R is a hydrocarbon group containing from about 1 to 250 carbon atoms, preferably 12 to 220 carbon atoms. The hydrocarbon group is, preferably, an aliphatic alkyl group which is saturated or unsaturated and may be straight chain or branched. The hydrocarbon-substituted succinic anhydride can be derived from a condensation reaction between an olefin and maleic anhydride. Suitable olefins include ethylene, propylene, butylene, isobutylene, pentylene, heptylene, decylene, dodecylene, eicosene, higher olefinic hydrocarbons as well as polymers and copolymers made from any of the foregoing olefins. The olefin can also contain cyclic hydrocarbon groups such as phenyl, naphthyl or alicycle. The hydrocarbon group can contain at least one heteroatom which is a nitrogen atom, sulfur atom or oxygen atom. In order for the final product to have the solubility properties necessary for beneficial emulsivity in lubricants, the hydrocarbon group should have an average molecular weight ranging from 140 to 3000, preferably from 140 to 2500, more specifically from 140 to 2000. Although polyisobutylene is a particularly preferred substituent, other substituents can be polypropylene, other polyolefins, as well as monomeric olefins such as dodecenyl.

To form the intermediate, the foregoing hydrocarbon-substituted succinic anhydride is reacted with an aminosalicylic acid which is represented by the following structural formula:

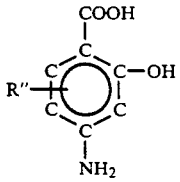

where R″ is a hydrogen atom or, preferably, a hydrocarbon group which contains 1 to 60 carbon atoms, preferably 12 to 60 carbon atoms. R″ can be an alkyl or alkenyl group or an aromatic or heterocyclic group. R″ can also be a hydrocarbon group containing 2 to 60 carbon atoms and at least one heteroatom such as an oxygen atom or sulfur atom.

An aldehyde serves as a linking group which joins the amino salicylic acid-containing intermediate with the alkylenepolyamine. Certain aldehydes which are suitable can be represented by the following characteristic group:

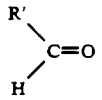

where R' is a hydrogen atom or a hydrocarbon group containing 1 to 60 carbon atoms which may be alkyl, aryl, alkylaryl or arylalkyl. The hydrocarbon can also contain at least one heteroatom such as an oxygen atom, sulfur atom or nitrogen atom. The aldehydes are made by known techniques or are available from commercial sources.

Representative examples of suitable aldehydes include formaldehyde, salicylaldehyde, acetaldehyde, propionaldehyde, butyraldehyde, benzaldehyde, nitrobenzaldehyde, tolualdehyde, phenylacetaldehyde, methylvaleraldehyde and paraformaldehyde which is a linear poly(oxymethylene glycol).

An alkylenepolyamine or mixture of alkylenepolyamines are combined with the intermediate aminosalicylic acid-derived succinimide and the aldehyde. The alkylenepolyamine contemplated has at least 2 primary amine groups, the nitrogen atom of one amine group being available for reaction with the aldehyde while the nitrogen atom of the second amine group being available for reaction with the anhydride. The contemplated polyamines include those having the structural formula:

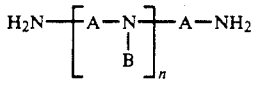

where A is an alkenyl group containing 1 to 10 carbon atoms, B is a hydrogen atom or a hydrocarbon group containing 1 to 30 carbon atoms and n is an integer ranging from 0 to 10. Representative examples of suitable alkylenepolyamines include ethylenediamine, diethylenetriamine, triethylenetetramine, tetraethylenepentamine and pentaethylenehexamine and mixtures thereof. Other alkylenepolyamines and polyalkylene polyamines i.e., polypropylene polyamines can be employed. Additionally contemplated polyamines are the aromatic amines, i.e., phenylenediamines and heterocyclic amines in which the amine is part of a cyclic system in which the other ring members are carbon atoms or at least one heteroatom which is oxygen, nitrogen or sulfur. An example of a suitable heterocycle is diaminoethylpiperazine. Mixtures of any of the amines can also be used successfully.

Thereafter the reaction product is post reacted with a second hydrocarbon-substituted succinic anhydride which is the same or different as the first hydrocarbon-substituted succinic anhydride. Each of the chemical structures of the first and second hydrocarbon-substituted succinic anhydrides fall within the same general description which is detailed above. That is, both hydrocarbon-substituted succinic anhydrides, although the same or different, can be characterized by the following structural formula:

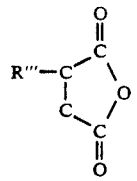

where R''' is a hydrocarbon group containing from about 1 to 250 carbon atoms, preferably 12 to 220 carbon atoms. The hydrocarbon group is, preferably, an aliphatic alkyl group which is saturated or unsaturated and may be straight chain or branched. The hydrocarbon-substituted succinic anhydride can be derived from a condensation reaction between an olefin and maleic anhydride. Suitable olefins include ethylene, propylene, butylene, isobutylene, pentylene, heptylene, decylene, dodecylene, eicosene, higher olefinic hydrocarbons as well as polymers and copolymers made from any of the foregoing olefins. The olefin can also contain cyclic hydrocarbon groups such as phenyl, naphthyl or alicycle. The hydrocarbon group can contain at least one heteroatom which is a nitrogen atom, sulfur atom or oxygen atom. Although polyisobutylene is a particularly preferred substituent, other substituents can be polypropylene, other polyolefins, as well as monomeric olefins such as dodecenyl.

The resulting reaction product can be represented by the following structural formula:

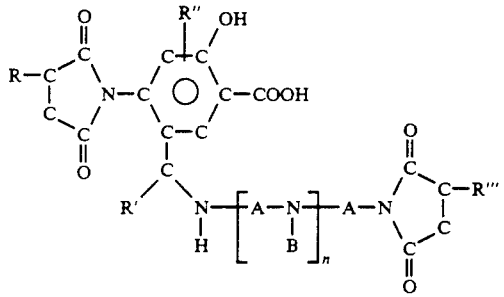

where R, R', R'', R''', A, B and n are as defined above. As shown in the graphic illustration of the reaction product, the product contains a carboxylic moiety which, when combined with the basic nitrogens present in the reaction mixture, may form an ammonium salt. It is believed that the presence of the charged species would have a surface active effect that would contribute to the metal surface protective properties of the additive.

In the reaction between the hydrocarbon-substituted succinic anhydride and the aminosalicylic acid there should be at least one equivalent of the amine group of the aminosalicylic acid for each equivalent of the anhydride. The aminosalicylic acid derived succinimide is contacted with the aldehyde in equimolar proportions, an equivalent amount of which reacts with the alkylene polyamine. Thereafter, a hydrocarbon-substituted succinic anhydride is combined with the reaction mixture to form the final product. If the polyamine contains more than two primary amines per molecule, then either additional anhydride or additional aldehyde or both can be used or the amine can remain unreacted.

The preferred method of synthesizing the reaction product is in a series of stepwise condensation reactions. The presence of an inert solvent capable of azeotropically removing the water of reaction can be used. A preferred solvent will provide a reflux temperature ranging from 80° to 160° C. Suitable solvents include xylenes, hexanes, benzene or toluene. A vacuum can also be used to remove the water of reaction. The product can, optionally, be filtered through celite. The reactants are contacted until such time that the reaction is complete.

The additives are most effectively utilized in fuels as detergents/dispersants, the fuels contemplated are liquid hydrocarbon and liquid oxygenated fuels such as alcohols and ethers i.e. methyl-tert-butyl ether (MTBE) and tert-amyl-methyl ether (TAME) and mixtures of liquid hydrocarbon and liquid oxygenated fuels. The additives can be blended in a concentration from about 25 to about 500 pounds of additive per 1000 barrels of fuel. The liquid fuel can be a liquid hydrocarbon fuel or an oxygenated fuel or mixtures thereof ranging from a ratio of hydrocarbon fuel to oxygenated fuel from about 100:0 to about 82:18. Liquid hydrocarbon fuels include gasoline, fuel oils, diesel oils and alcohol fuels include methyl and ethyl alcohols and, as previously mentioned, ethers.

Specifically, the fuel compositions contemplated include gasoline components such as a mixture of hydrocarbons boiling in the gasoline boiling range which is from about 90° F. to about 450° F. This base fuel may consist of straight chains or branched chains paraffins, cycloparaffins, olefins, aromatic hydrocarbons, or mixtures thereof. The base fuel can be derived from among others, straight run naphtha, polymer gasoline, alkylate natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point from about 75° F. to about 135° F. and an end boiling point from about 250° F. to about 750° F. It should be noted in this respect that the term distillate fuels is not intended to be restricted to straight-run distillate fractions. These distillate fuel oils can be straight-run distillate fuel oils catalytically or thermally cracked (including hydrocracked) distillate fuel oils etc. Moreover, such fuel oils can be treated in accordance with well-known commercial methods, such as acid or caustic treatment, dehydrogenation, solvent refining, clay treatment and the like.

Contemplated among the fuel oils are Nos. 1, 2 and 3 fuel oils used in heating and as Diesel fuel oils, gasoline, turbine fuels and jet combustion fuels.

The fuels may contain alcohols and/or gasoline in amounts of 0 to 50 volumes per volume of alcohol. The fuel may be a complete (100%) alcohol-type fuel containing little or no hydrocarbon. Typical of such fuels are methanol, ethanol and mixtures of methanol and ethanol. The fuels which also may be treated with the additive include gasohols which may be formed by mixing 90 to 95 volumes of gasoline with 5-10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

The reaction products can also be blended with lubricants in a concentration of about 0.01% to 15%, preferably, from 0.05% to 10% by weight of the total composition.

The contemplated lubricants are liquid oils in the form of either a mineral oil or synthetic oil or mixtures thereof. Also contemplated are greases in which any of the foregoing oils are employed as a base.

In general, the mineral oils, both paraffinic and naphthenic and mixtures thereof can be employed as a lubricating oil or as the grease vehicle. The lubricating oils can be of any suitable lubrication viscosity range, for example, from about 45 SUS at 100° F. to about 6000 SUS at 100° F., and preferably from about 50 to 900 SUS at 100° F. These oils may have V1 to 100 or higher.

Where synthetic oils, or synthetic oils employed as the vehicle for the grease are desired in preference to mineral oils, or in mixtures of mineral and synthetic oils, various synthetic oils may be used.

The following example describes the invention in more detail.

EXAMPLE 1

To 100 g (0.08 mol) of a 920 molecular weight polyisobutylene alkylated succinic anhydride was added 12.2 g (0.08 mol) of 4-aminosalicylic acid and 200 mL of xylenes in a 2 L reactor. The reactor was equipped with a mechanical stirrer, $N_2$ inlet, thermometer and condenser with Dean-Stark trap. The mixture was heated to 140° C. for 4 hours during which time water (1 mL; 1.4 mL water expected) was azeotropically removed. The reaction mixture was cooled, then 2.4 g (0.08 mol) of formaldehyde and 165 g (0.08 mol) of tetraethylenepentamine was added. The mixture was reheated to 145° C. for 1.5 hours during which time water (1.4 mL; 1.4 mL water expected) was azeotropically removed. The reaction mixture was cooled, then 100 g (0.08 mol) of the 920 molecular weight polyisobutylene succinic anhydride was added and the mixture was reheated to 145° C. for 1.5 hours during which time water (1.4 mL; 1.4 mL water expected) was azeotropically removed. The reaction was cooled, and the solvent was removed by rotary evaporation. The resulting brown viscous liquid was hot filtered through celite.

EVALUATION OF THE PRODUCTS

The additive was tested for its effectiveness as a carburetor detergent in the CRC Carburetor Detergency Test. The procedure was designed to determine the effectiveness of an additized fuel to remove preformed deposits in the carburetor. The base fuel employed in the test consists of aromatics (47%), olefins (12%) and saturates (41%). The Carburetor Detergency Test consisted of two cycles. The first cycle of the test is run on the unadditized base fuel for 20 hours, and would typically provide ~30 mg of deposits on the carburetor sleeve. This is classified as the "dirty-up" phase. The second cycle of the test is run for 20 hours on the same fuel additized with the experimental additive to assess its clean-up ability. The experimental additive to be evaluated was blended into the fuel at a treat rate of 100 lb/MB. The effectiveness of the additized fuel is expressed in a percentage, with a positive difference indicating the fuel composition of the process was effective in the removal of deposits introduced by the base fuel. The results obtained are reported as a % reduction in the carburetor sleeve deposits, indicating the % deposits removed from the dirty throttle body. This additive was evaluated in two different test engines, designated Front Engine and Rear Engine.

TABLE 1

CRC Carburetor Clean-Up Detergency Test

| Run | Additive Fuel Composition | Deposit (mg) | % Effectiveness |
|---|---|---|---|
| Front Engine | | | |
| 1 | Base Fuel | 29 | — |
| 2 | Base Fuel + Example 1 | 10 | 66 |
| Rear Engine | | | |
| 1 | Base Fuel | 33 | — |
| 2 | Base Fuel + Example 1 | 12 | 64 |

The foregoing test shows that the fuel composition containing the described additive exhibited very effective carburetor detergency properties. In addition, the similarity in the results obtained for both the Front and Rear engines demonstrated good correlation between the engines.

What is claimed is:

1. A fuel additive having carburetor detergency properties comprising a reaction product of (a) an intermediate reaction product of a hydrocarbon-substituted succinic anhydride and an aminosalicylic acid having the structural formula:

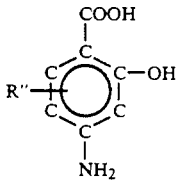

where R'' is a hydrogen atom or a hydrocarbon group which contains 1 to 60 carbon atoms or a hydrocarbon group containing 2 to 60 carbon atoms and at least one heteroatom which is an oxygen atom or sulfur atom, the hydrocarbon-substituted succinic anhydride has the structural formula:

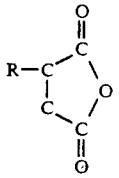

where R is a hydrocarbon group containing from about 1 to 250 carbon atoms, the intermediate reaction product of (a) further reacted with (b) and (c) to form a product where (b) is an aldehyde; and (c) is an alkylenepolyamine; the product of (a), (b) and (c) further reacted with (d) where (d) is a hydrocarbon-substituted succinic anhydride which has the structural formula:

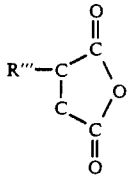

where R''' is a hydrocarbon group containing from about 1 to 250 carbon atoms.

2. The fuel additive of claim 1 in which the hydrocarbon group, represented by R, of the hydrocarbon-substituted succinic anhydride, of step a., is an olefin selected from the group consisting of ethylene, propylene, butylene, isobutylene, pentylene, heptylene, decylene, dodecylene, eicosene, higher olefinic hydrocarbons, polymers of said olefins and copolymers said olefins.

3. The fuel additive of claim 1 in which the hydrocarbon group, represented by R''', of the hydrocarbon-substituted succinic anhydride, of step d., is an olefin selected from the group consisting of ethylene, propylene, butylene, isobutylene, pentylene, heptylene, decylene, dodecylene, eicosene, higher olefinic hydrocarbons, polymers of said olefins and copolymers said olefins.

4. The fuel additive of claim 1 in which the aldehyde is selected from the group consisting of salicylaldehyde, formaldehyde, acetaldehyde, propionaldehyde, butyraldehyde, benzaldehyde, nitrobenzaldehyde, tolualdehyde, phenylacetaldehyde, methylvaleraldehyde and paraformaldehyde.

5. The fuel additive of claim 1 in which the alkylenepolyamine has the following structural formula:

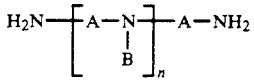

where A is an alkylene group containing 1 to 10 carbon atoms, B is a hydrogen atom or an alkylene group containing 1 to 30 carbon atoms and n is an integer ranging from 0 to 10.

6. The fuel additive of claim 7 in which the alkylene polyamine is selected from the group consisting of ethylenediamine, diethylenetriamine, triethylenetetramine, tetraethylenepentamine and pentaethylenehexamine.

7. A fuel composition comprising a major proportion of a fuel selected from the group consisting of liquid hydrocarbon or liquid oxygenated or mixtures thereof and a minor proportion of a reaction product having carburetor detergency properties derived from (a) an intermediate reaction product of a hydrocarbon-substituted succinic anhydride and an aminosalicylic acid having the structural formula:

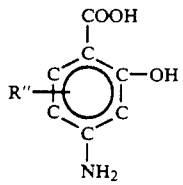

where R'' is a hydrogen atom or a hydrocarbon group which contains 1 to 60 carbon atoms or a hydrocarbon group containing 2 to 60 carbon atoms and at least on e heteroatom which is an oxygen atom or sulfur atom, the hydrocarbon-substituted succinic anhydride having the structural formula:

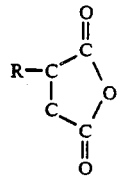

where R is a hydrocarbon group containing from about 1 to 250 carbon atoms; the intermediate reaction product of (a) further reacted with (b) and (c) to form a product where (b) is an aldehyde; and (c) is an alkylenepolyamine; the product of (a), (b) and (c) further reacted with (d) where (d) is a hydrocarbon-substituted succinic anhydride which has the structural formula:

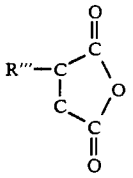

where R''' is a hydrocarbon group containing from about 1 to 250 carbon atoms.

8. The fuel composition of claim 7 in which the hydrocarbon group, represented by R, of the succinic anhydride, of step a., is an olefin selected from the group consisting of ethylene, propylene, butylene, isobutylene, pentylene, heptylene, decylene, dodecylene, eicosene, higher olefinic hydrocarbons, polymers of said olefins and copolymers said olefins.

9. The fuel composition of claim 7 in which the hydrocarbon group, represented by R''', of the hydrocarbon-substituted succinic anhydride, of step d., is an olefin selected from the group consisting of ethylene, propylene, butylene, isobutylene, pentylene, heptylene, decylene, dodecylene, eicosene, higher olefinic hydrocarbons, polymers of said olefins and copolymers said olefins.

10. The fuel composition of claim 7 in which the aldehyde is selected from the group consisting of salicylaldehyde, formaldehyde, acetaldehyde, propionaldehyde, butyraldehyde, benzaldehyde, nitrobenzaldehyde, tolualdehyde, phenylacetaldehyde, methylvaleraldehyde and paraformaldehyde.

11. The fuel composition of claim 7 in which the alkylenepolyamine has the following structural formula:

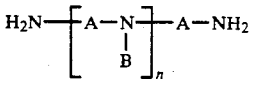

where A is an alkylene group containing 1 to 10 carbon atoms, B is a hydrogen atom or an alkylene group containing 1 to 30 carbon atoms and n is an integer ranging from 0 to 10.

12. The fuel composition of claim 11 in which the alkylene polyamine is selected from the group consisting of ethylenediamine, diethylenetriamine, triethylenetetramine, tetraethylenepentamine and pentaethylenehexamine.

13. A fuel composition prepared by blending a major amount of a fuel selected from the group consisting of liquid hydrocarbon or liquid oxygenated or mixtures thereof with a minor additive amount of a carburetor detergency reaction product of (a) an intermediate reaction product of a hydrocarbon-substituted succinic anhydride and an aminosalicylic acid having the structural formula:

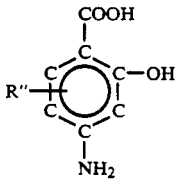

where R'' is a hydrogen atom or a hydrocarbon group which contains 1 to 60 carbon atoms or a hydrocarbon group containing 2 to 60 carbon atoms and at least one heteroatom which is an oxygen atom or sulfur atom, the hydrocarbon-substituted succinic anhydride having the structural formula:

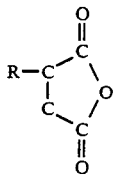

where R is a hydrocarbon group containing from about 1 to 250 carbon atoms; the intermediate reaction product of (a) further reacted with (b) and (c) to form a product where (b) is an aldehyde; and (c) is an alkylenepolyamine; the product of (a), (b) and (c) further reacted with (d) where (d) is a hydrocarbon-substituted succinic anhydride which has the structural formula:

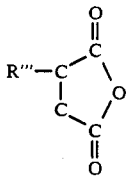

where R''' is a hydrocarbon group containing from about 1 to 250 carbon atoms.

14. The fuel composition of claim 13 in which the hydrocarbon group, represented by R, of the succinic anhydride, of step a., is an olefin selected from the group consisting of ethylene, propylene, butylene, isobutylene, pentylene, heptylene, decylene, dodecylene, eicosene, higher olefinic hydrocarbons, polymers of said olefins and copolymers said olefins.

15. The fuel composition of claim 13 in which the hydrocarbon group, represented by R''', of the hydrocarbon-substituted succinic anhydride, of step d., is an olefin selected from the group consisting of ethylene, propylene, butylene, isobutylene, pentylene, heptylene, decylene, dodecylene, eicosene, higher olefinic hydrocarbons, polymers of said olefin and copolymers said olefins.

16. The fuel composition of claim 13 in which the aldehyde is selected from the group consisting of salicylaldehyde, formaldehyde, acetaldehyde, propionaldehyde, butyraldehyde, benzaldehyde, nitrobenzaldehyde, tolualdehyde, phenylacetaldehyde, methylvaleraldehyde and paraformaldehyde.

17. The fuel composition of claim 13 in which the alkylenepolyamine has the following structural formula:

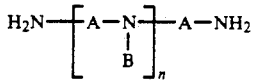

where A is an alkylene group containing 1 to 10 carbon atoms, B is a hydrogen atom or an alkylene group containing 1 to 30 carbon atoms and n is an integer ranging from 0 to 10.

18. The fuel composition of claim 17 in which the alkylene polyamine is selected from the group consisting of ethylenediamine, diethylenetriamine, triethylenetetramine, tetraethylenepentamine and pentaethylenehexamine.

* * * * *